US010352064B2

(12) United States Patent
Gilmer

(10) Patent No.: US 10,352,064 B2
(45) Date of Patent: Jul. 16, 2019

(54) STAKE

(71) Applicant: STAKEBOSS LLC, Hesperia, CA (US)

(72) Inventor: Tyrone Gilmer, Hesperia, CA (US)

(73) Assignee: STAKEBOSS LLC, Hesperia, CA (US)

( * ) Notice: Subject to any disclaimer, the term of this patent is extended or adjusted under 35 U.S.C. 154(b) by 0 days.

(21) Appl. No.: 16/000,230

(22) Filed: Jun. 5, 2018

(65) Prior Publication Data

US 2018/0347226 A1 Dec. 6, 2018

Related U.S. Application Data

(60) Provisional application No. 62/603,536, filed on Jun. 5, 2017.

(51) Int. Cl.
*E04H 15/62* (2006.01)

(52) U.S. Cl.
CPC ..... *E04H 15/62* (2013.01)

(58) Field of Classification Search
CPC .... E04H 15/62; E04H 12/223; E04H 12/2215
USPC ..... 135/118; 52/155; 248/156
See application file for complete search history.

(56) References Cited

U.S. PATENT DOCUMENTS 147,928 A * 2/1874 Fry ..... A01K 1/04 119/780
362,183 A * 5/1887 Runyon ..... E02D 5/803 52/162
1,008,323 A * 11/1911 Gillespie ..... E02D 5/803 135/118
1,854,671 A * 4/1932 Roberts ..... E04H 15/62 135/98
2,001,719 A * 5/1935 Greene ..... E04H 12/223 52/158
2,771,163 A * 11/1956 Mafera, Jr. ..... E02D 5/803 52/153
3,195,697 A * 7/1965 Case ..... E04H 12/223 403/218
3,788,336 A 1/1974 Steffes
5,291,703 A * 3/1994 Ziegler ..... G01C 15/04 411/456
6,256,942 B1 * 7/2001 Schatz ..... E02D 5/803 135/118
6,932,164 B1 8/2005 Williston
7,082,954 B1 8/2006 Flanery et al.
(Continued)

*Primary Examiner* — Noah Chandler Hawk
(74) *Attorney, Agent, or Firm* — Loza & Loza, LLP; Heidi L. Eisenhut

(57) ABSTRACT

A quick and easy way of combining items needed for connecting and securing tents and tarps to a stake in the ground is provided. The stake has an elongated metal shaft with the bottom of the shaft tapered into a triangular shape for easily entering the ground. First and second sets of slots may be located on front and back surfaces of the shaft, respectively. Flexible pins may be inserted into a slot on the front surface of the shaft and extend out a corresponding slot on the back surface of the shaft. A user then bends the portion of the flexible pin extending out the back surface for added gripping strength of the stake when inserted into the ground. The stakes may include a wire or cable connected to a fastener which is used to secure the tent, tarp or tarp like item to the stake.

18 Claims, 9 Drawing Sheets

(56) References Cited

U.S. PATENT DOCUMENTS

| | | | | |
|---|---|---|---|---|
| 7,225,760 | B2 * | 6/2007 | Krieger | A01K 1/04 119/769 |
| 7,743,548 | B1 * | 6/2010 | Cashaw | A01K 97/11 43/15 |
| 2001/0039769 | A1 | 11/2001 | Orr | |
| 2013/0233366 | A1 | 9/2013 | Burgess et al. | |

* cited by examiner

STAKE

CLAIM OF PRIORITY

The present application for patent claims priority to U.S. Provisional Application No. 62/603,536 entitled "TRAP READY STAKE KITS", filed Jun. 5, 2017 and which is hereby expressly incorporated by reference herein.

FIELD

The present disclosure generally relates to stakes and more particularly to stakes that may be easily driven into various types of ground surfaces for securing a tent, tarp, cover, portable shelter or any other type of device to the ground using a stake.

BACKGROUND

Tents and tarps have been in use for many years. There are various ways to secure tents and tarps to the ground such as placing tires, bricks and stones on them, however, many of these items used to secure the tents and tarps are unsightly. Another method that is commonly used for securing tents and tarps is the gathering and assembly of several items for attaching and securing the tents and tarps to the ground. Not only is the gathering and assembly of items time consuming, it can also be quite expensive due to the number of necessary items that need to be purchased.

These time consuming and tedious practices require users to gather together several different types of items such as clamps, bungee cords and stakes to attach and secure tents, tarps and tarp like items to the ground.

In view of the aforementioned problems, a stylish connection and securing device integrated with all necessary different types of items that are required to efficiently secure or tie down tents, tarps and tarp like items to the ground is needed.

SUMMARY

The following presents a simplified summary of one or more implementations in order to provide a basic understanding of some implementations. This summary is not an extensive overview of all contemplated implementations, and is intended to neither identify key or critical elements of all implementations nor delineate the scope of any or all implementations. Its sole purpose is to present some concepts of one or more implementations in a simplified form as a prelude to the more detailed description that is presented later.

According to one feature, a stake for tying down a tent or tart is provided. The stake includes an elongated member compromising a proximal section; a distal section; and a medial section integrally connected between the proximal section and the distal section. The stake further comprises a cap detachably connected to the proximal section of the elongated member; a first pin extending into a first slot in a front surface of the elongated member and extending out a first slot in a back surface of the elongated member; and a second pin extending into a second slot in the back surface of the elongated member and extending out a second slot in the front surface of the elongated member.

According to one aspect, the first pin includes a first portion integrally connected to a second portion by a middle portion; wherein the first portion and the second portion of the first pin are parallel to the longitudinal axis of the stake; and wherein the middle portion of the first pin extends through the elongated member in a horizontal plane.

According to another aspect, the second pin includes a first portion integrally connected to a second portion by a middle portion; wherein the first portion and the second portion of the second pin are parallel to the longitudinal axis of the stake; and wherein the middle portion of the second pin extends through the elongated member in a horizontal plane.

According to yet another aspect, the distal section comprises an elongated hollow shaft; and wherein the elongated hollow shaft tapers toward a longitudinal axis of the stake providing a pointed ground-entering end.

According to yet another aspect, the stake further comprises a first end of a wire secured to a crimp anchor located within the proximal section of the elongated hollow shaft.

According to yet another aspect, the stake further comprises a protection sleeve coupled to the crimp anchor by the first end of the wire, the protection sleeve having a head portion integrally connected to a sleeve portion and where the sleeve portion extends horizontally outward from a hole located in the elongated hollow shaft.

According to yet another aspect, the head portion of the protection sleeve is located within the proximal section of the elongated hollow shaft.

According to yet another aspect, the wire extends out the sleeve portion avoiding contact with the elongated hollow shaft preventing fraying.

According to yet another aspect, the sleeve portion is made from a rigid or semi-rigid material.

According to yet another aspect, wherein a second end of the wire is secured to a fastener and the fastener is a carabiner.

According to yet another aspect, wherein a second end of the wire extends through a hole in the fastener and loops back and is secured to a crimping sleeve forming a crimping loop.

According to yet another aspect, wherein the crimping loop is placed around the proximal end of the elongated hollow shaft.

According to yet another aspect, wherein the cap is placed onto the proximal end of the elongated shaft shortening a distance between the fastener and an object being secured by the fastener.

According to yet another aspect, the stake further comprises an attachment holder integrally connected to the elongated member by a horizontal shaft.

According to yet another aspect, wherein the attachment holder comprises a tubular member having a closed bottom end and an open top end.

According to yet another aspect, wherein the tubular member is configured for holding a fishing pole.

According to yet another aspect, wherein the first and second portions of the first pin are distorted wedging the stake within soil as the stake is driven into the soil.

According to yet another aspect, wherein the first and second portions of the second pin are distorted wedging the stake within soil as the stake is driven into the soil.

DETAILED DESCRIPTION

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details.

In the following description, certain terminology is used to describe certain features of one or more embodiments. The term "stake" may refer to a general category of outdoor fasteners that may be inserted, pounded or driven into the ground as a marker, anchor or support. According to one aspect, the stake may be utilized for anchoring, holding or supporting a portable shelter, such as a tent, a tarp or cover, in place or any other type of structure that utilizes stakes to secure the structure. The stake may be made from any material known in the art, including but not limited to, wood, metal and plastic. The term "ground" may refer to a solid surface of the earth including but not limited to soil, sand, clay, dirt and any combination thereof. The term "wire" may refer to a cable, a rope, a string, a bungee cord, a cord, a lead, a coil or any other type of elongated material that may be used to connect or secure items together.

Overview

One feature of the present disclosure provides a quick and easy way of combining all items needed for connecting and securing tents, tarps and tarp like items to the ground. In one aspect, a stake having an elongated metal shaft where the bottom of the shaft is tapered into a triangular shape for easily entering the ground. A first set of slots may be located on a front surface of the metal shaft and a second set of slots may be located on a back surface of the metal shaft. Flexible pins may be inserted into a slot on the front surface of the metal shaft and extend out a corresponding slot on the back surface of the metal shaft. A user may then bend the portion of the flexible pin extending out the back surface for added gripping strength of the stake when inserted into the ground. Alternatively, a flexible pin may be inserted into a slot on the back surface of the metal shaft and extend out the front surface of the metal shaft. A user may then bend the portion of the flexible pin extending out the front surface for added gripping strength of the stake when inserted into the ground. As described in more detail below, the stakes may include a wire or cable connected to a fastener which is used to secure the tent, tarp or tarp like item to the stake.

Stake

Figure 1:
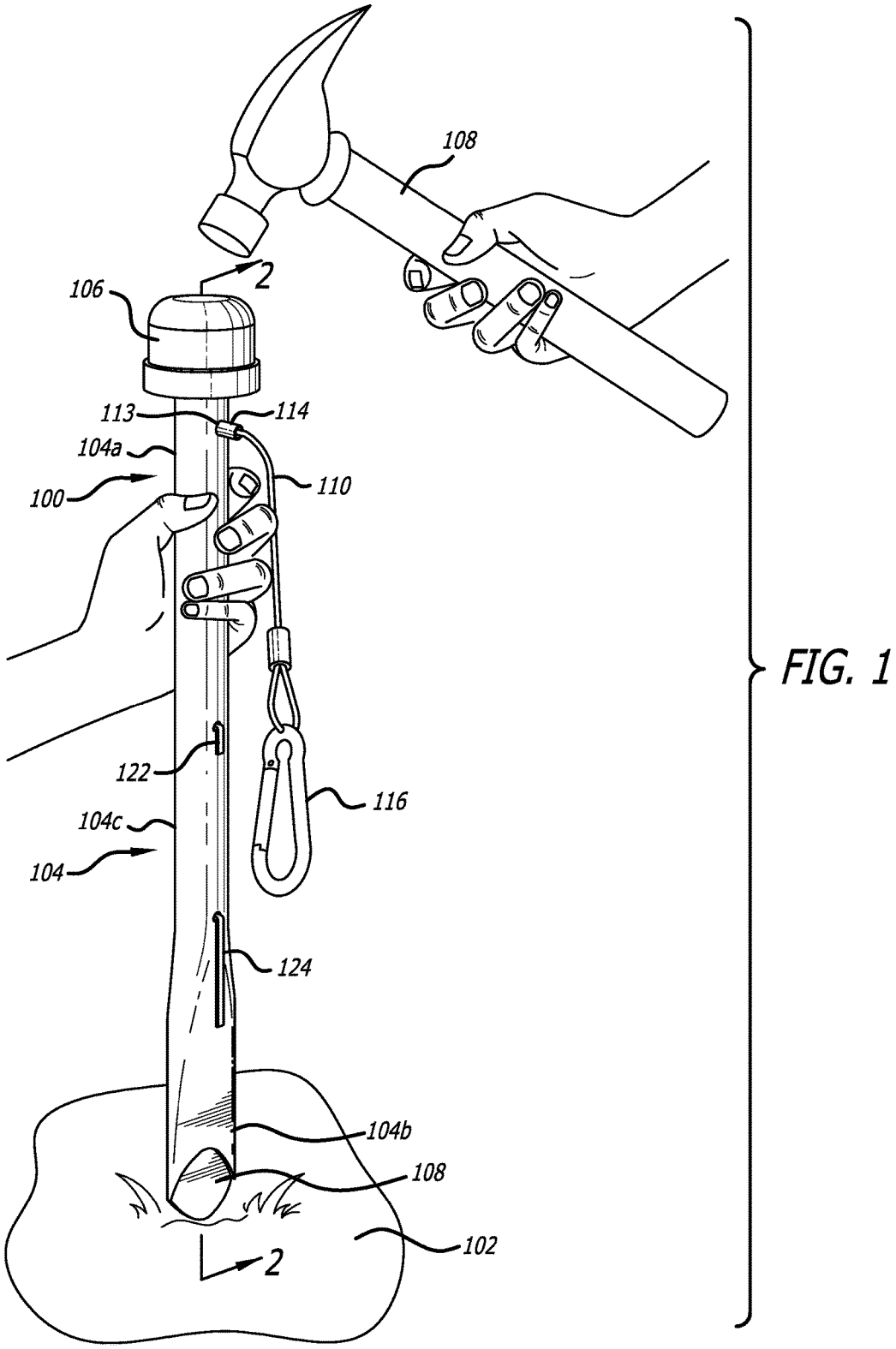
FIG. 1 is an environmental view of a stake being driven into the ground.
Figure 2:
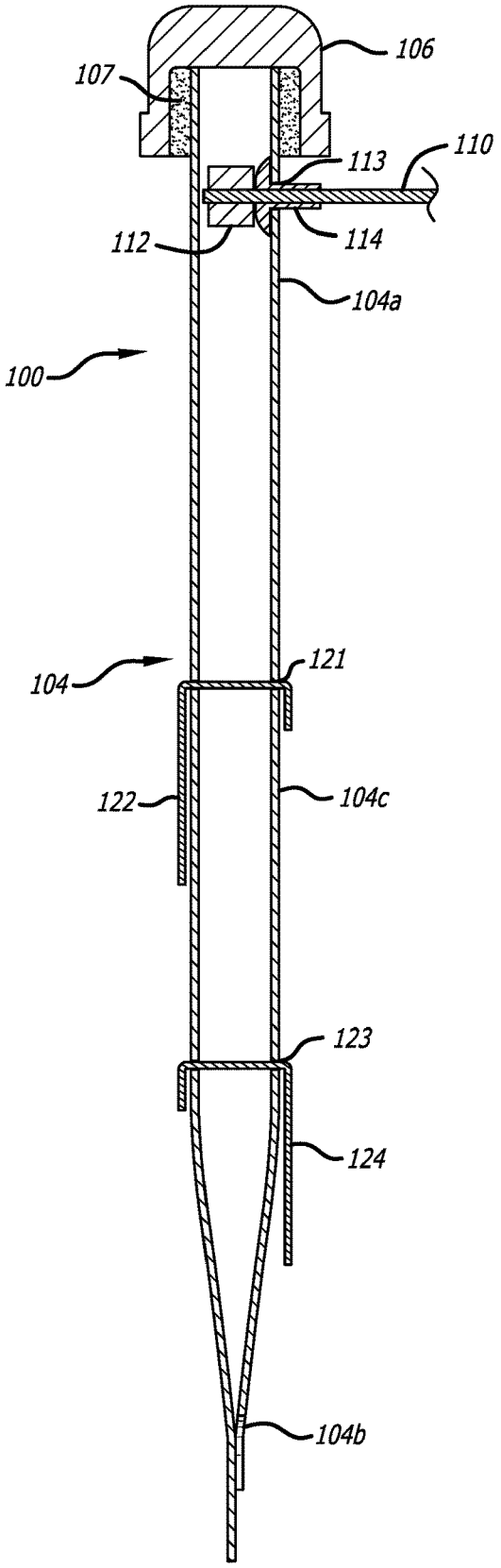
FIG. 2 is a cross sectional view of the stake taken along line 2-2 of FIG. 1.
Figure 3:
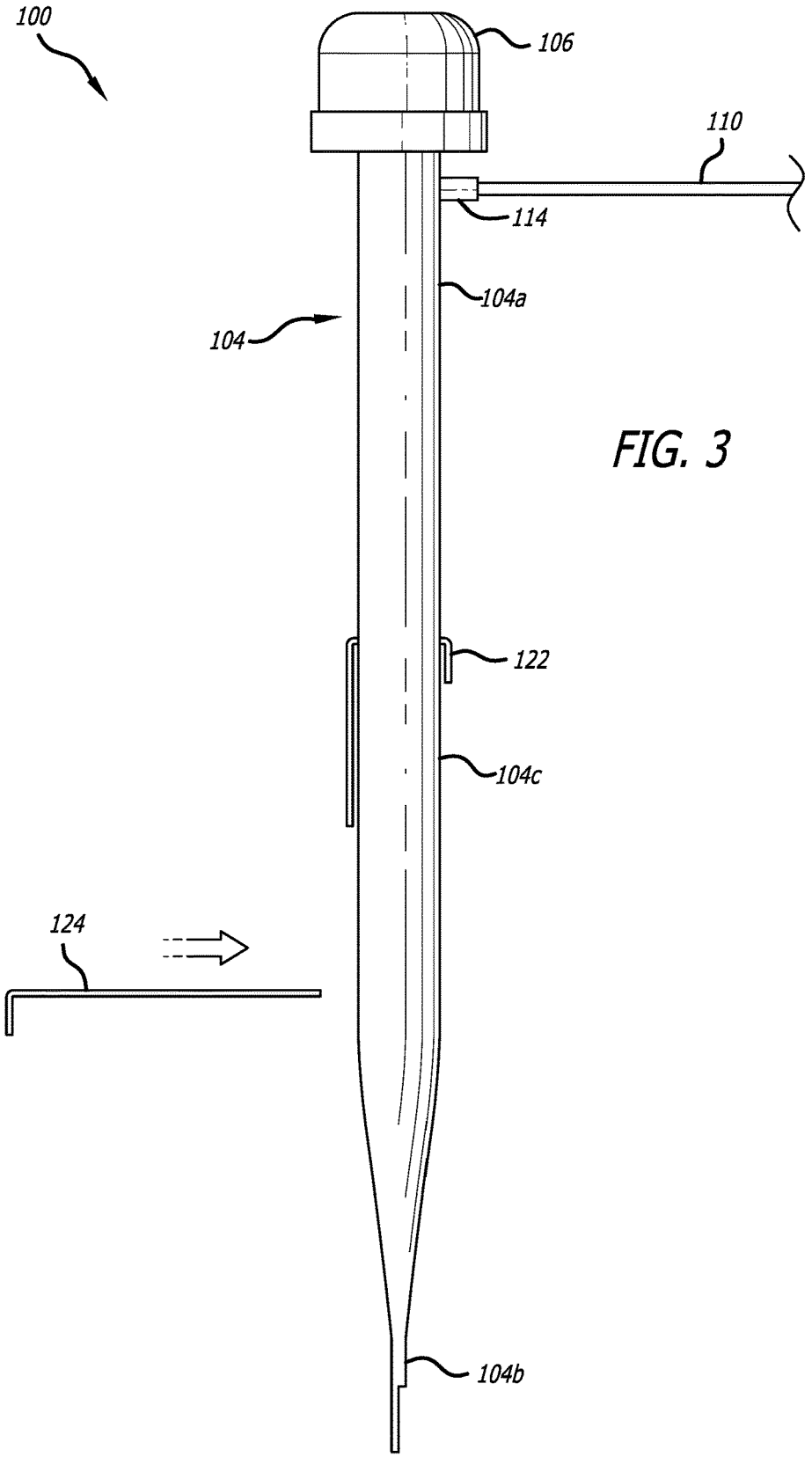
FIG. 3 is a first side view of the stake of having a first pin secured to an elongated shaft of the stake.

FIG. 1 is an environmental view of a stake 100 being driven into the ground 102. FIG. 2 is a cross sectional view of the stake taken along line 2-2 of FIG. 1. The stake 100 may be utilized to secure a tent, tarp or tarp like item to the ground. As shown, the stake 100 may include an elongated member 104 having a proximal section 104*a* that may be detachably secured to a cap 106, a distal section 104*b* providing a relatively pointed ground-entering end 108 and a medial section 104*c* integrally connected between the proximal section 104*a* and the distal section 104*b*. The proximal and medial sections 104*a*, 104*c* may comprise an elongated hollow shaft while the distal section 104*b* may comprise an elongated hollow shaft that tapers toward the longitudinal axis of the stake 100 to provide a pointed ground-entering end. In one example, distal section 104*b* may be a closed end having a triangular configuration allowing the bottom end 108 of the stake 100 to be easily driven into various types of ground covers and soils.

The interior side wall of the cap 106 may include a rubber material 105 so that the cap 106 fits tightly around the proximal section 104*a* of the elongated member 104. In order to drive the stake 100 into the ground 102, the cap 106 may be struck with a suitable implement such as a hammer 108. Although the suitable implement is shown as a hammer 108, this is by way of example only and any type of tool or object that is capable of driving the stake into the ground 102 may be utilized, including but not limited to a mallet, club, rod or rock. The rubber material 105 in the interior surface of the cap 106 allows the cap 106 to fit snugly onto the proximal portion 104*a* of the elongated shaft 104*a*. The exterior of the cap 106 may be made from any type of metal, plastic or other material known in the art.

As shown in FIG. 2, a first end of a wire 110 may be secured to a crimp anchor 112 located within the proximal section 104*a* of the elongated hollow shaft. From the crimp anchor 112 the wire 110 may extend through a protection sleeve having a head portion and a sleeve portion 114. The head portion of the protection sleeve may be located within the proximal section 104*a* of the elongated hollow shaft 104.

The sleeve portion 114 may extend outwardly from a hole 113 in the proximal section 104*a* of the elongated hollow shaft 104 while the head of the protection sleeve is larger than the hole 113 and prevents the protective sleeve from being removed from the interior of the elongated hollow shaft 104. The sleeve portion 114 may have a rigid or semi-rigid structure to contain the wire 110, or for which the wire 110 is passed through, preventing the wire 110 from rubbing against the elongated member of the stake 100 and consequently preventing the wire 110 from fraying. The head of the protection sleeve may be integrally connected to the sleeve portion 114 which, as described above, extends out through the hole 113 in the proximal section 104*a* of the elongated hollow shaft 104.

A second end of the wire 100 may be secured to a fastener 116, such as a carabiner, or any other type of clip or fastener known in the art. In one example, the second end of the wire 110 may extend through a hole in the fastener 116 and loop back such that the second end of the wire 110 may be crimped to a portion of the wire by a crimping sleeve 120 and forming a crimping loop 118.

According to another aspect, the elongated member 104 may include a first set of slots (See FIG. 11, reference numbers 126 and 128) on the front of the elongated member 104 and a second set of slots (not shown) on the back of the elongated member 104. Each slot in the first set of slots may correspond to a slot in the second set of slots forming a pair of slots located within the same horizontal plane. Although two pairs of slots are shown in FIG. 2, this is by way of example only and there may be one pair of slots or more than two pairs of slots. As shown in FIGS. 1, 2, 5-8, and 11, a first pin 122 may be placed through a first pair of slots and a first portion of the first pin 122 may be bent at a 90 degree angle from the horizontal plane causing the first pin 122 to stop when the first portion of the first pin 122 reaches the elongated member 104. The first pin 122 may then extend outwardly from the pair of slots in a horizontal plane. Next, a user may bend the second portion of the first pin 122 which extends outwardly from the back surface of the elongated member by hand into a downward position in a vertical plane toward the ground or soil 102.

Figure 4:
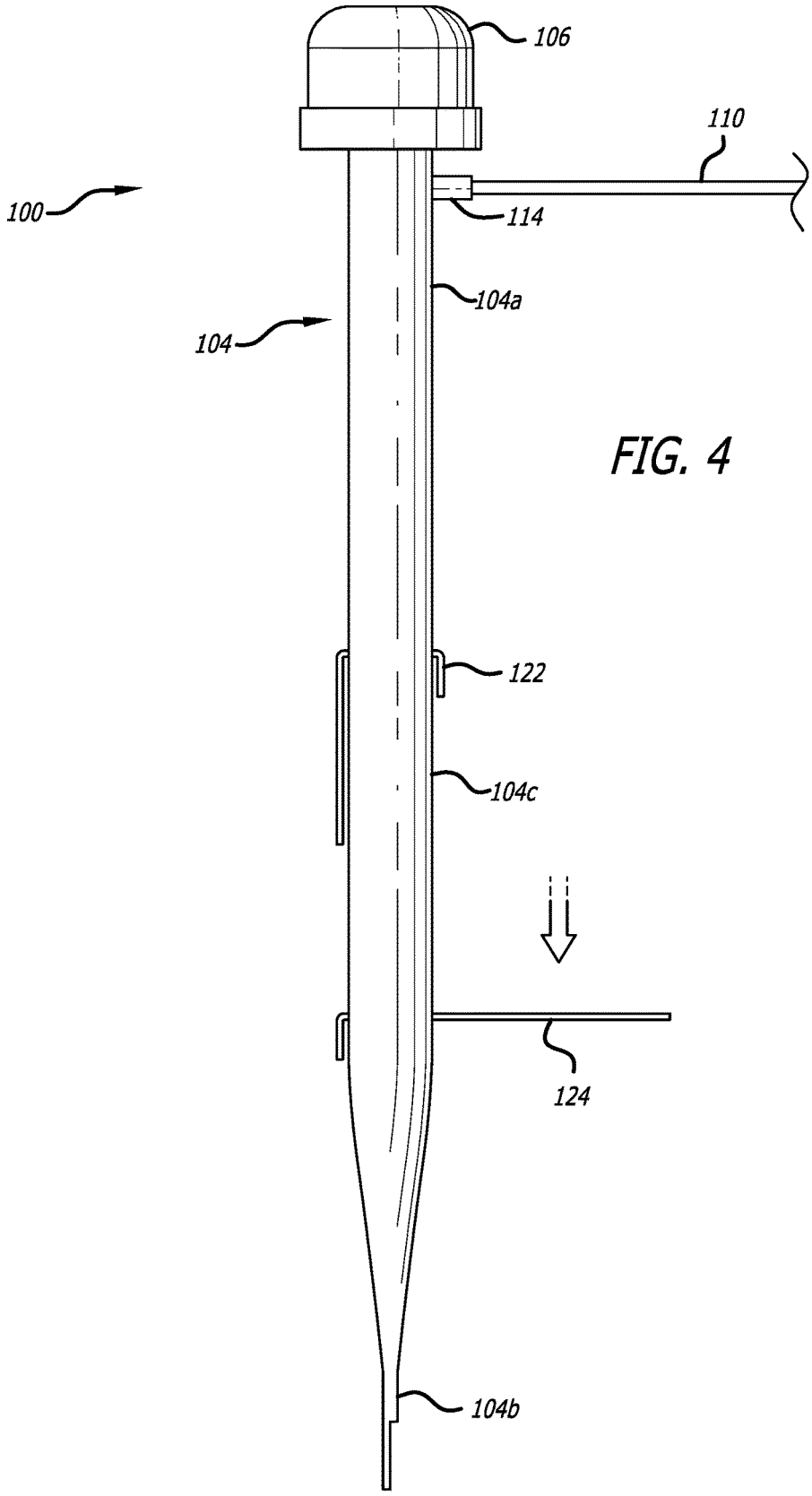
FIG. 4 is the first side view of the stake of having the first pin secured to the elongated shaft and a second pin extending through the elongated shaft.

A second pin 124 may be placed through a second pair of slots and a first portion of the second pin 124 may be bent at a 90 degree angle from the horizontal plane causing the second pin 124 to stop when the first portion of the second pin 124 reaches the back surface of the elongated member 104. The second portion of the second pin 124 may then extend outwardly from the pair of slots in a horizontal plane. (See FIG. 4) Next, a user may bend the second portion of the second pin 124 extending outwardly from the front surface of the elongated member by hand into a downward position in a vertical plane toward the ground or soil 102. (See FIG. 5)

Although the first and second pins 122, 124 are shown entering slots on opposite sides or surfaces of the elongated member 104 (that is the back surface and the front surface), this is by way of example only and the first and second pins 122, 124 may enter the slots through the same side or surface of the elongated member 104.

Figure 5:
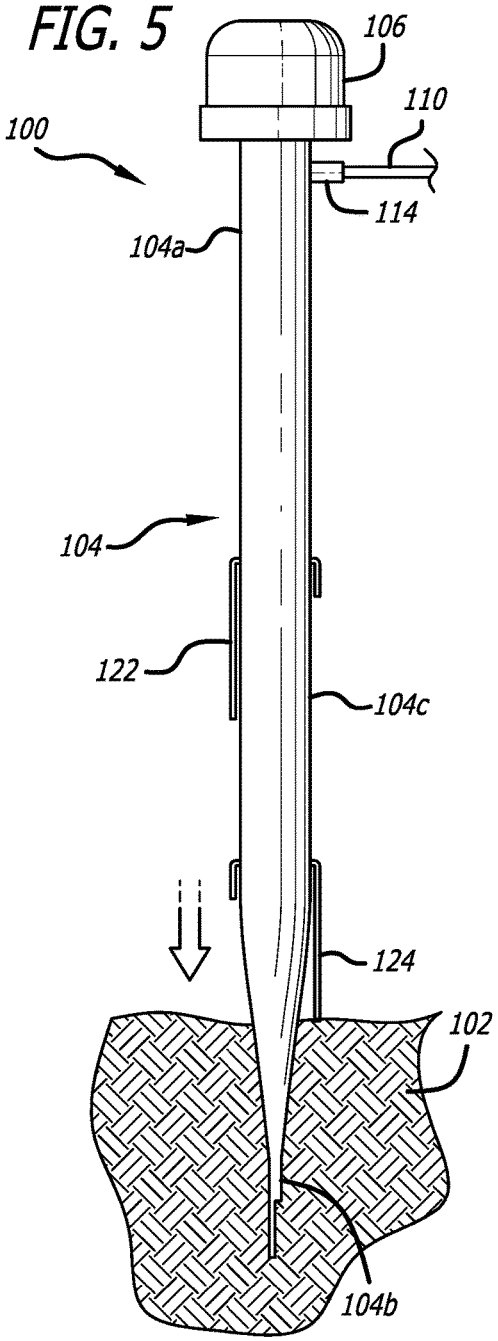
FIG. 5 is the first side view of the stake of FIG. 1 with a distal end being driven into the ground.
Figure 6:
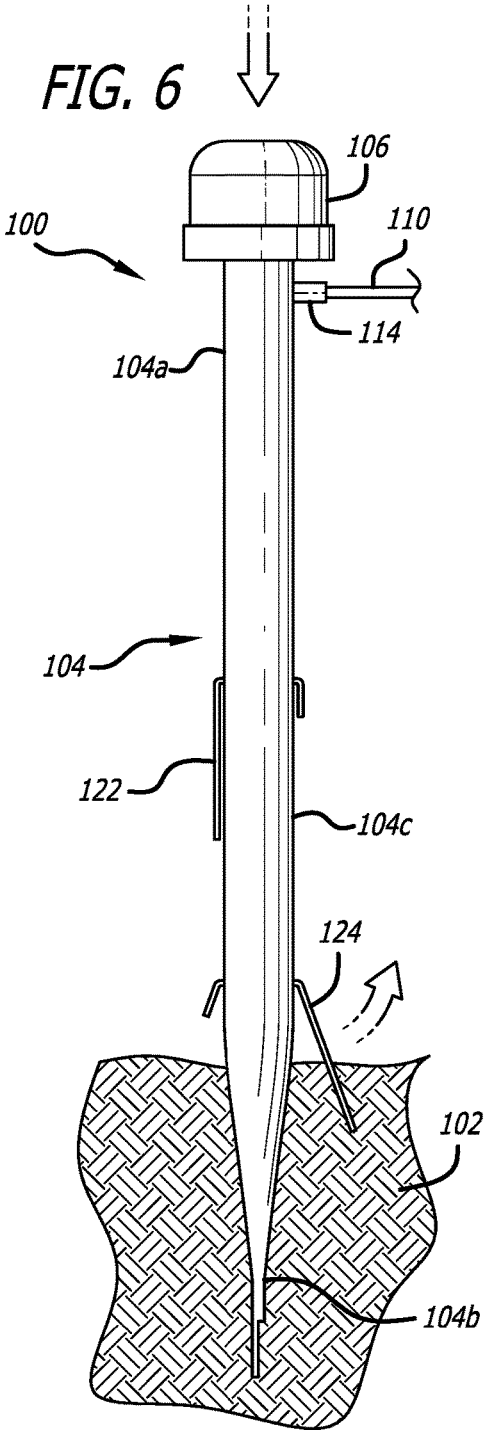
FIG. 6 is the first side view of the stake of FIG. 5 driven further into the ground causing the second pin to bend outwardly.
Figure 7:
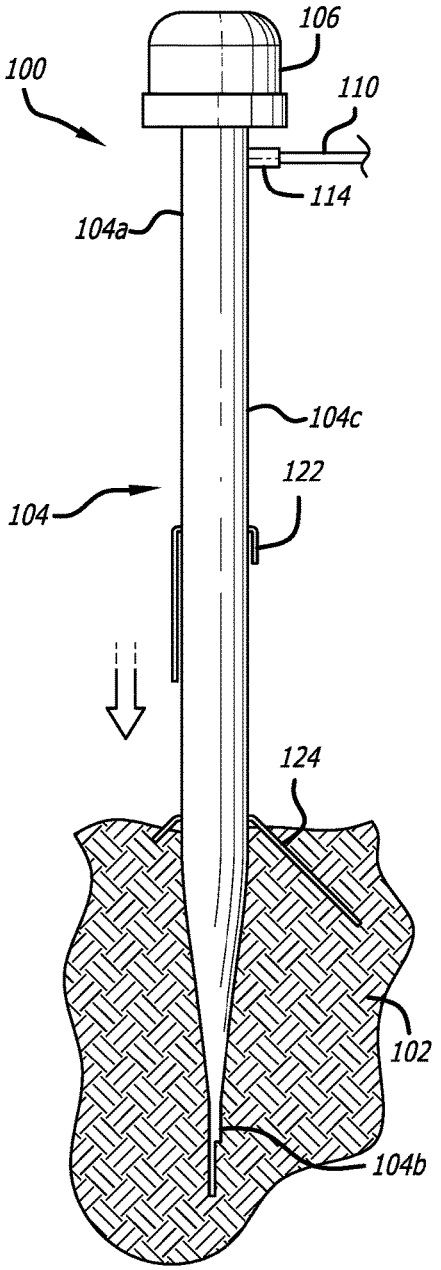
FIG. 7 is the first side view of the stake of FIG. 6 driven even further into the ground causing the second pin to continue to bend outwardly.
Figure 8:
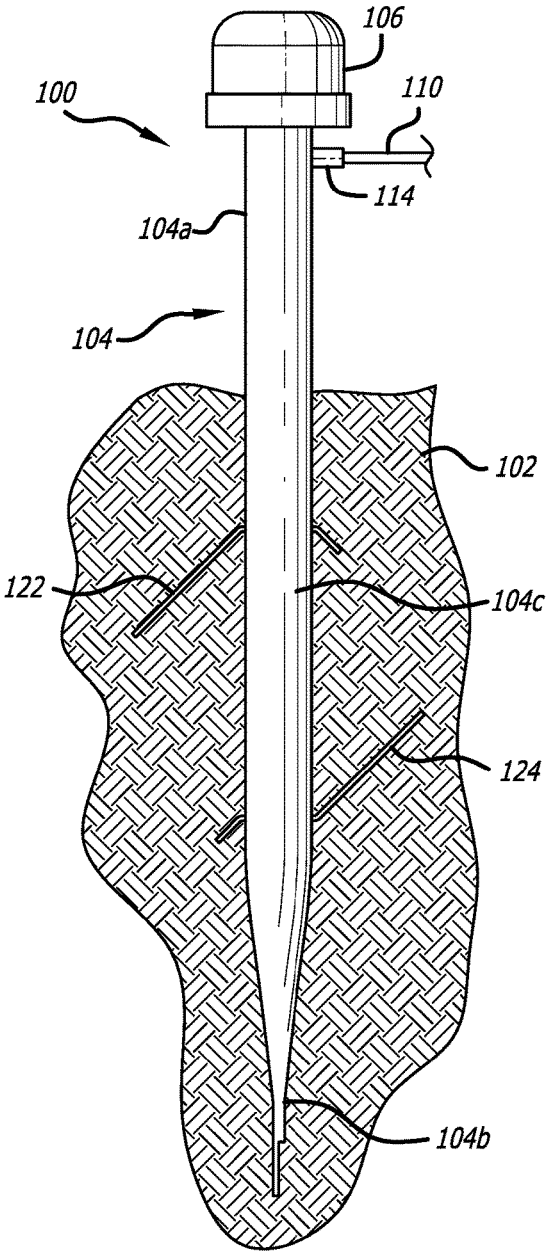
FIG. 8 is the first side view of the stake of FIG. 7 driven yet even further into the ground causing the second pin to continue bending outwardly in an upwards direction and the first pin to bend outwardly.

FIGS. 5-8 illustrate the stake 100 being driven into the ground 102 at various different stages of the installation. First, as shown in FIG. 5, the distal section 104*b* of the elongated member 104 of the stake 100 provides a relatively pointed ground-entering end 108 that is driven into the soil 102. As the stake 100 continues to be pounded or pressed into the soil 102, the second portion of the second pin 124 in a vertical plane begins to move or bend outwardly as the second pin 124 is lifted and distorted wedging the stake 100 against the soil 102. (See FIG. 6). As shown in FIG. 7, the second pin 124 continues to be lifted and distorted as the stake 100 is further driven into the soil 102. In FIG. 8, the second portion of the second pin 124 continues to be pushed upward as the stake 100 is driven further into the ground 102. As a result, the second portion of the second pin 124 may extend past 45 degrees or even 90 degrees from the longitudinal axis of the stake 100. As shown in FIG. 8, the second portion of the second pin 124 may extend approximately 135 degrees from the longitudinal axis of the stake 100. In one example, the second portion of the second pin 124 may extend between 0 degrees and 135 degrees from the longitudinal axis of the stake 100. In another example, the second portion of the second pin 124 may extend between 0 degrees and 45 degrees or between 0 degrees and 180 degrees from the longitudinal axis of the stake 100.

Additionally, as shown in FIG. 8, the second portion of the second pin 122 in a vertical plane begins to move or bend outwardly as the first pin 122 is lifted and distorted wedging the stake 100 against the soil 102. As discussed with the second pin 124, the second portion of the first pin 122 may extend between 0 degrees and 135 degrees from the longitudinal axis of the stake 100 or between 0 degrees and 45 degrees or between 0 degrees and 180 degrees from the longitudinal axis of the stake 100. The distortion of the first and second pins 122, 124 wedges the stake 100 further into the soil 102 making it more difficult for the stake 100 to be accidentally pulled out or blown away.

As discussed above with respect to FIG. 8, the stake 100 is driven even further into the soil 102 so that the second portion of the second pin 124 continues to be lifted and distorted such that the hand bent portion extends upwards and the second portion of the first pin 124 in a vertical plane begins to move outwardly as the second portion of the first pin 122 begins to move outwardly as the first pin 122 is lifted and distorted wedging the stake 100 against the soil 102. The distortion of the first and second pins 122, 124 further embeds the stake 100 into the soil making it difficult to easily pull the stake out of the ground 102.

Figure 9:
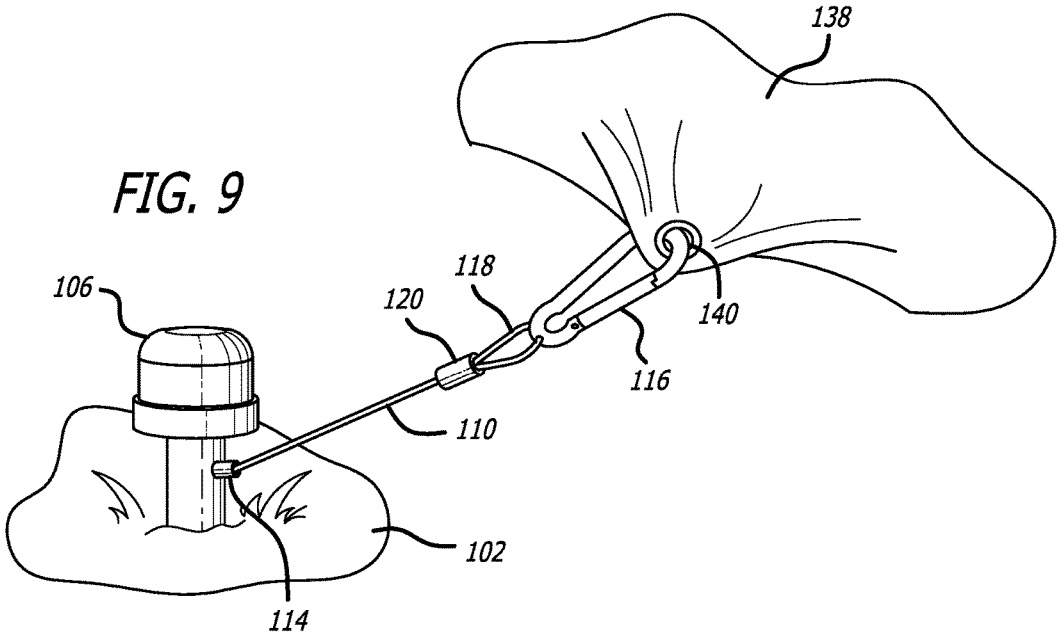
FIG. 9 is a top portion of a stake driven into the ground having a wire with a fastener for securing the stake to a tent or tarp.

FIG. 9 illustrates a top portion of the stake 100 driven into the ground having a wire 110 extending out the sleeve portion 114 which extends outwardly from the elongated hollow member 104. As described above, the wire 110 may be connected to and pass through a hole in the fastener 116 where the fastener may be utilized to hook into or pass through a hole 140 in a tent or tarp. The hole 140 in the tent or tarp may include a grommet placed in the hole 1440 to prevent the fastener 116 (or alternatively a rope or wire 110) from tearing the sheet or panel of the tent or tarp.

Figure 10:
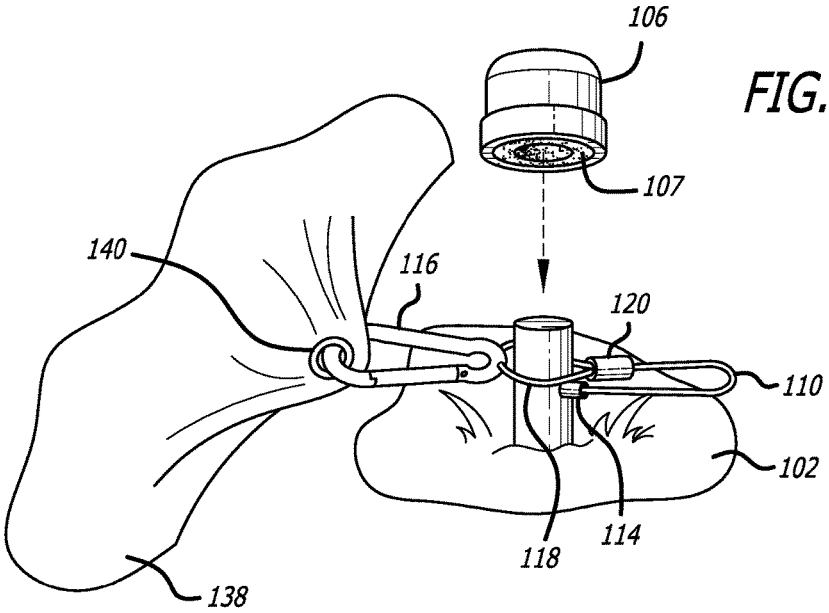
FIG. 10 is a partial view of a stake with the cap removed for securing a looping wire around the distal end of the elongated member.

To prevent damage from high winds, the cap 106 may be removed from the stake 100 and the crimping loop 118 formed by the wire 110 and secured by a crimping sleeve 120 may be placed around the distal section 104*a* of the elongated member 104. After placing the crimping loop 118 over or around the distal section 104*a* of the elongated member 104, the cap 106 may be secured again to the elongated member 104. As a result, the fastener 116 is limited in its movement from the stake 100 securing the tent or tarp closer to the stake 100 and preventing the tent or tarp from moving and blowing wildly within the wind causing damage to the tent or tarp or alternatively preventing the tent or tarp from flying away. Thus, FIG. 10 provides the user with an option of added protection to the wire 110 to prevent fraying in high winds as well as providing a wider radius vertically and horizontally.

Stake with Attachment Holder

Figure 11:
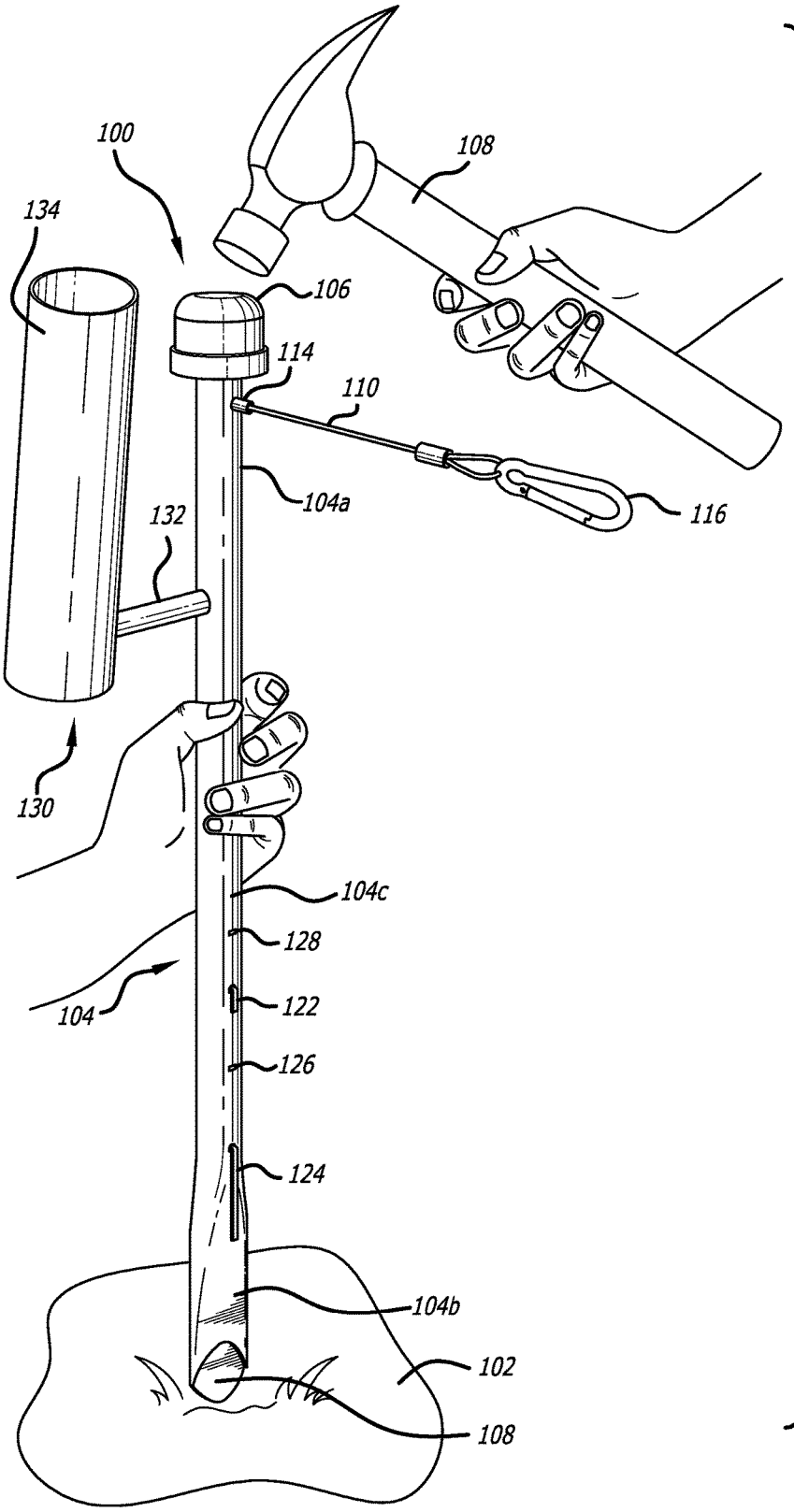
FIG. 11 is an environmental view of a stake having an attachment holder being driven into the ground.

Turning to FIG. 11, an environmental view of a stake 100 having an attachment holder 130 being driven into the ground 102 is shown. As described above, the stake 100 may include an elongated member 104 having a proximal section 104*a* that may be detachably secured to a cap 106, a distal section 104*b* providing a relatively pointed ground-entering end 108 and a medial section 104*c* integrally connected between the proximal section 104*a* and the distal section 104*b*. The proximal and medial sections 104*a*, 104*c* may comprise an elongated hollow shaft while the distal section 104*b* may comprise an elongated hollow shaft that tapers toward the longitudinal axis of the stake 100 to provide a pointed ground-entering end. In one example, distal section 104*b* may be a closed end having a triangular configuration allowing the bottom end 108 of the stake 100 to be easily driven into various types of ground covers and soils. First and second pins 122, 124 may be inserted into the elongated member 140 and bent downwards by hand as described above. The first and second pins 122, 124 may be inserted into alternative slots 126, 128 or additional pins may be inserted into slots 128, 128.

Additionally, the sleeve portion 114 may extend out from a hole 113 in the elongated hollow shaft 104. The sleeve portion 114 may have a rigid or semi-rigid structure to contain the wire 110, or for which the wire 110 is passed through, preventing the wire 110 from rubbing against the elongated member 104 of the stake 100 and consequently preventing the wire 110 from fraying. A second end of the wire 100 may be secured to a fastener 116, such as a carabiner, or any other type of clip or fastener known in the art. In one example, the second end of the wire 110 may extend through a hole in the fastener 116 and loop back such that the second end of the wire 110 may be crimped to a portion of the wire by a crimping sleeve 120 and forming a crimping loop 118.

The attachment holder 130 may be comprised of a tubular member 134 having a closed bottom end and an open top end. The tubular member 134 may be secured to the elongated member 104 by a horizontal shaft 132 extending from the elongated member 104 to the tubular member 134. The tubular member 134 be within the same vertical plane as the elongated member 104 or the tubular member 134 may be angled slightly. According to one example, a fishing rod 123 may be stored or placed into the tubular member 134. Alternatively, a flag pole may be stored or placed into the tubular member 134. The fishing rod 123 and the flag pole are merely examples and other object may be stored in and extend out from the tubular member 134.

Figure 12:
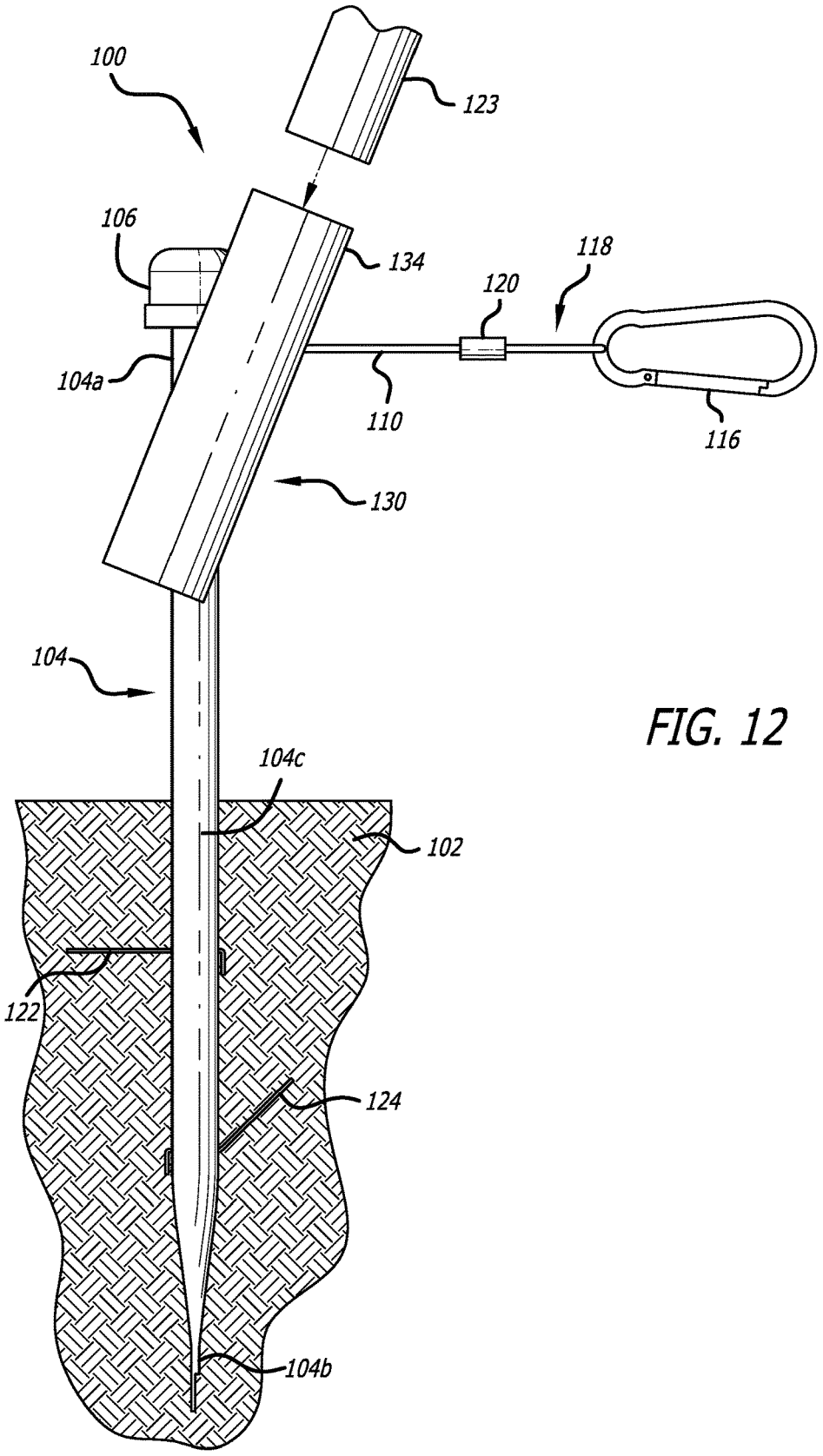
FIG. 12 illustrates the stake of FIG. 11 driven into the ground and a pole being placed into the attachment holder.

FIG. 12 illustrates the stake of FIG. 11 driven into the ground 102, using the hammer 108 of FIG. 11, and a pole 123 being placed into the attachment holder 130. In this example, the second portion of the second pin 124 is at an angle of approximately 135 degrees from the longitudinal axis of the stake 100 while the second portion of the first pin 122 is at an angle of approximately 90 degrees from the longitudinal axis of the stake 100. The distortion of the first and second pins 122, 124 wedges the stake 100 further into the soil 102 102 making it more difficult for the stake 100 to be accidentally pulled out or blown away.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language of the claims, wherein reference to an element in the singular is not intended to mean "one and only one" unless specifically so stated, but rather "one or more." Unless specifically stated otherwise, the term "some" refers to one or more. A phrase referring to "at least one of" a list of items refers to any combination of those items, including single members. As an example, "at least one of: a, b, or c" is intended to cover: a; b; c; a and b; a and c; b and c; and a, b and c. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for."

Accordingly, the various features associate with the examples described herein and shown in the accompanying drawings can be implemented in different examples and implementations without departing from the scope of the disclosure. Therefore, although certain specific constructions and arrangements have been described and shown in the accompanying drawings, such implementations are merely illustrative and not restrictive of the scope of the disclosure, since various other additions and modifications to, and deletions from, the described implementations will be apparent to one of ordinary skill in the art. Thus, the scope of the disclosure is only determined by the literal language, and legal equivalents, of the claims which follow.

What is claimed is:

1. A stake, comprising: an elongated member, comprising:
- a proximal section; a distal section;
- a medial section integrally connected between the proximal section and the distal section;
- a cap detachably connected to the proximal section of the elongated member;
- a first pin extending into a first slot in a front surface of the elongated member and extending out a first slot in a back surface of the elongated member; and
- a second pin extending into a second slot in the back surface of the elongated member and extending out a second slot in the front surface of the elongated member; and
- wherein the first pin includes a first portion integrally connected to a second portion by a middle portion;
- wherein the first portion and the second portion of the first pin are parallel to the longitudinal axis of the stake; and
- wherein the middle portion of the first pin extends through the elongated member in a horizontal plane.

2. The stake of claim 1, wherein the second pin includes a first portion integrally connected to a second portion by a middle portion; wherein the first portion and the second portion of the second pin are parallel to the longitudinal axis of the stake; and wherein the middle portion of the second pin extends through the elongated member in a horizontal plane.

3. The stake of claim 2, wherein the first and second portions of the second pin are distorted wedging the stake within soil as the stake is driven into the soil.

4. The stake of claim 1, wherein the distal section comprises an elongated hollow shaft; and wherein the elongated hollow shaft tapers toward a longitudinal axis of the stake providing a pointed ground-entering end.

5. The stake of claim 4, further comprising a first end of a wire secured to a crimp anchor located within the proximal section of the elongated hollow shaft.

6. The stake of claim 5, further comprising a protection sleeve coupled to the crimp anchor by the first end of the wire, the protection sleeve having a head portion integrally connected to a sleeve portion and where the sleeve portion extends horizontally outward from a hole located in the proximal section of the elongated hollow shaft.

7. The stake of claim 6, wherein the head portion of the protection sleeve is located within the proximal section of the elongated hollow shaft.

8. The stake of claim 6, wherein the wire extends out the sleeve portion avoiding contact with the elongated hollow shaft preventing fraying.

9. The stake of claim 6, wherein the sleeve portion is made from a rigid or semi-rigid material.

10. The stake of claim 5, wherein a second end of the wire is secured to a fastener.

11. The stake of claim 10, wherein the fastener is a carabiner.

12. The stake of claim 5, wherein a second end of the wire extends through a hole in the fastener and loops back and is secured to a crimpling sleeve forming a crimping loop.

13. The stake of claim 12, wherein the crimping loop is placed around the proximal end of the elongated hollow shaft.

14. The stake of claim 12, wherein the cap is placed onto the proximal end of the elongated shaft shortening a distance between the fastener and an object being secured by the fastener.

15. The stake of claim 1, further comprising an attachment holder integrally connected to the elongated member by a horizontal shaft.

16. The stake of claim 15, wherein the attachment holder comprises a tubular member having a closed bottom end and an open top end.

17. The stake of claim 15, wherein the tubular member is configured for holding a fishing pole.

18. The stake of claim 1, wherein the first and second portions of the first pin are distorted wedging the stake within soil as the stake is driven into the soil.

* * * * *